US007012369B2

(12) United States Patent
Charlier

(10) Patent No.: US 7,012,369 B2
(45) Date of Patent: Mar. 14, 2006

(54) SYSTEM FOR ATTACHING A FILAMENT TO A CURRENT LEAD-IN

(75) Inventor: Jean-Paul Charlier, Eply (FR)

(73) Assignee: Koninklijke Philips Electronics N.V., Eindhoven (NL)

( * ) Notice: Subject to any disclaimer, the term of this patent is extended or adjusted under 35 U.S.C. 154(b) by 50 days.

(21) Appl. No.: 10/277,588

(22) Filed: Oct. 22, 2002

(65) Prior Publication Data

US 2003/0076036 A1 Apr. 24, 2003

(30) Foreign Application Priority Data

Oct. 23, 2001 (FR) ..... 01 13671

(51) Int. Cl.
*H01K 1/50* (2006.01)

(52) U.S. Cl. ..... 313/578; 313/315; 313/316

(58) Field of Classification Search ..... 313/578, 313/271, 273, 269, 279, 315, 316, 183
See application file for complete search history.

(56) References Cited

U.S. PATENT DOCUMENTS 1,590,164 A * 6/1926 Harrington et al. ..... 313/276
1,884,957 A * 10/1932 Adams et al. ..... 313/274
3,634,722 A * 1/1972 Palmer et al. ..... 313/279
3,678,319 A * 7/1972 Notelteirs et al. ..... 313/271
3,696,265 A * 10/1972 Martin et al. ..... 313/579
3,733,508 A * 5/1973 Rainone et al. ..... 313/579
3,736,455 A * 5/1973 Notelteirs et al. ..... 313/274
3,780,333 A * 12/1973 Flynn ..... 313/274
3,875,443 A * 4/1975 Nakamura ..... 313/274
3,909,653 A * 9/1975 Bottone et al. ..... 313/271
3,986,067 A * 10/1976 De Fraeye ..... 313/273
4,145,630 A * 3/1979 DeCaro et al. ..... 313/273
4,317,060 A * 2/1982 Fitzgerald et al. ..... 313/113
4,366,411 A * 12/1982 Robinson ..... 313/272
5,900,696 A * 5/1999 Buschmann et al. ..... 313/578
6,291,934 B1 9/2001 Berger et al. ..... 313/623
6,791,247 B1 * 9/2004 Takahashi ..... 313/271

* cited by examiner

*Primary Examiner*—Joseph L. Williams
*Assistant Examiner*—Peter Macchiarolo

(57) ABSTRACT

A filament assembly employs one set of primary filament coils (200) disposed in a spiral around one axis of revolution (220) is connected to one set of secondary filament coils (202) by a spacer (205) including at least two coils (205*a* and 205*b*) connected to the primary filament coils (200) and the secondary filament coils (202). The coils (205*a* and 205*b*) establish at least two attachment points for attachment of the spacer (205) to a hook (207*a*) of a metal current supply rod (207).

17 Claims, 3 Drawing Sheets

SYSTEM FOR ATTACHING A FILAMENT TO A CURRENT LEAD-IN

BACKGROUND OF THE INVENTION

1. Technical Field of the Invention

The present invention relates to a filament assembly including primary coils disposed in a spiral around an axis of revolution and secondary coils connected to the primary coils by a spacer.

2. Description of the Prior Art

One known filament assembly in the art includes a filament composed of several portions disposed in two planes. Two metal rods, electrically connected to two of the filament portions and to an external electrical circuit, enable the filament assembly to be supplied with current. These two metal rods have at one end a hook oriented about an axis of revolution and are electrically connected to the two portions by two spacers which are inserted in the hooks on the metal rods. Each spacer is thus in contact with the hook of a metal supply rod at an attachment point dependent on a curvature of the spacer.

Such a spacer is obtained while the filament is being manufactured by a momentary interruption of a coiling process for making the turns of the filament. This interruption in the coiling process is a tricky operation that results in a random curvature of the spacer, that is to say the attachment point may be situated either to the left or to the right of the axis of revolution of the hook on the metal rod. However, the applicant has found that, during an operation of assembling the filament and the metal current supply rods, inserting the spacer in the hook of a metal rod is particularly difficult if the attachment point is situated on a certain side of the axis of revolution of the hook, and easier if the attachment point is situated on the other side. Essentially the degree of difficulty of inserting the spacer in the hook is dependent upon an orientation of the hook.

However, in various commercially available lamps, the two metal supply rods are symmetrical. Consequently, when the attachment point of a spacer is situated on one side of the axis of revolution of the hook to which it is connected and the attachment point of the other spacer is situated on the other side of the axis of revolution of the hook to which it is connected, assembling the filament is difficult.

However, even if the two supply rods are asymmetrical, a similar problem arises when the two attachment points are situated on the same side of the two axes of revolution of the hooks on the metal supply rods.

Such a situation gives rise to a relatively long assembly time and to risks of breakage of the filament.

SUMMARY OF THE INVENTION

It is an object of the invention to facilitate the assembly of a filament.

According to the invention, as spacer has at least two coils stretched in a direction to parallel to the axis of revolution of the portion.

The term 'stretched' means that the coils of the spacer have between them a greater spacing than a spacing of the primary filament coils or the secondary filament coils. For example, the spacing between two coils of the primary portion may be 0.2 mm and the spacing between two coils on the spacer 2 mm.

By having at least two coils, the spacer has at least two possible attachment points on the metal current supply rod. At least one of these attachment points is situated on one side of the axis of revolution of the hook to which the spacer is connected, so that inserting the spacer into the hook is easy. Thus, the assembly of the filament in a lamp is facilitated as would be appreciated by those having ordinary skill in the art.

Accordingly, if only one of the two filament spacers has at least two coils, then a positioning step makes it possible to position the other spacer during the filament assembly operation such that its attachment point is situated on one side of the axis of revolution of the hook to which it is connected, whereby an insertion of the spacer in the hook is easy. The spacer having at least two coils will then necessarily have at least one attachment point situated on the side of the axis of revolution of the hook to which it is connected, whereby an insertion of the spacer in the hook is easy. Consequently, the assembly of the filament in a lamp is facilitated as would be appreciated by those having ordinary skill in the art. If the two spacers have at least two coils, then they each necessarily have at least one attachment point situated on the side of the axis of revolution of the hook to which they are connected, so that inserting the spacer into the hook is easy. Consequently, the assembly of the filament in a conventional lamp is facilitated in such a case and does not require the placement step necessary if only one spacer has at least two coils. Such a reasoning is valid both for symmetrical and asymmetrical metal supply rods.

BRIEF DESCRIPTION OF THE FIGURES

The invention will be further described with reference to embodiments shown in the drawings to which, however, the invention is not restricted.

DETAILED DESCRIPTION OF THE PRESENTLY PREFERRED EMBODIMENTS

Figure 1B:
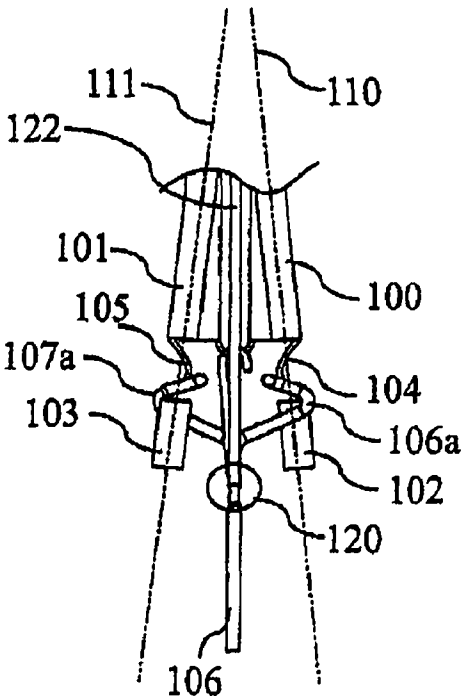
FIG. 1B (Prior Art)
FIGS. 1A and 1B are a front view and a left-hand view of a filament assembly according to the prior art, respectively.
Figure 1A:
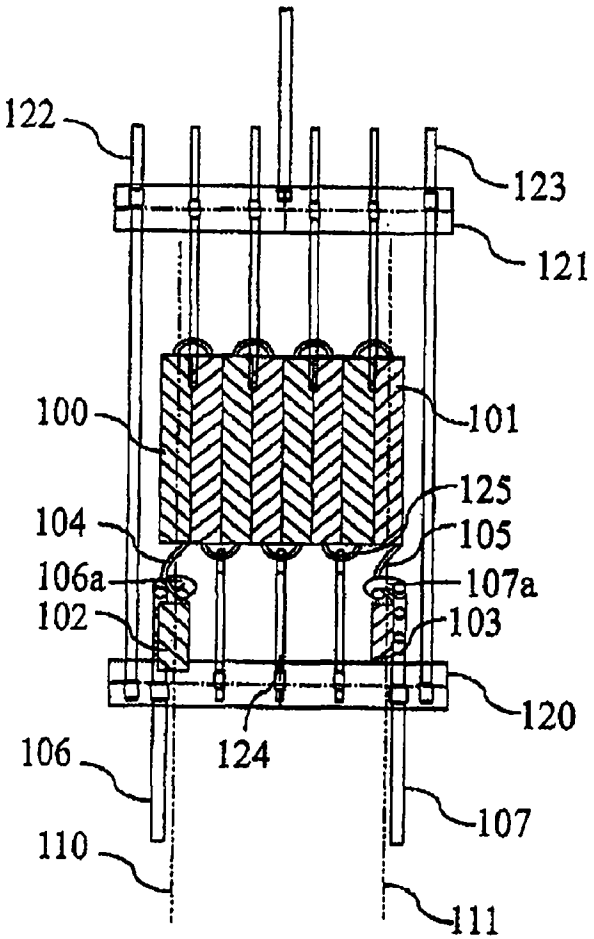
FIG. 1A (Prior Art)

FIGS. 1A and 1B illustrate a filament assembly of the prior art. A description of such a filament assembly gives an understanding of a problem resolved by the invention.

The filament assembly employs primary filament coils 100, primary filament coils 101, a secondary filament coils 102, a secondary filament coils 103, a spacer 104, a spacer 105, a metal supply rod 106 having a hook 106*a*, a metal supply rod 107 having a hook 107*a*, bridges 120 and 121 connected by metal bars 122 and 123, spacers 124, and filament loops 125. The primary filament coils 100 have a first axis of revolution 110, the primary filament coils 101 have a second axis of revolution 111. The axes of revolution of the hooks 106*a* and 107*a* coincide substantially with the first axis of revolution 110 and the second axis of revolution 111. It will be considered below that the axis of revolution of the hook 106*a* is the first axis of revolution 110 and that the axis of revolution of the hook 107*a* is the second axis of revolution 111. The filament employs four primary coil sections situated at the front of a plane defined by the spacers 124. Primary filament coils 100 is one of these four primary coil sections. The filament also employs four primary coil sections situated at the rear of a plane defined by the spacers 124. Primary filament coils 101 is one of these four primary coil sections.

In order to manufacture such a filament, a tungsten wire is wound in order to obtain the secondary filament coils 102. The coiling process is then interrupted in order to obtain the spacer 104, then resumed in order to obtain a long helical part, then once again interrupted in order to obtain the spacer 105 and finally resumed in order to obtain the secondary filament coils 103. The long helical part is then folded into eight primary coil sections separated by loops 125, and the filament thus obtained undergoes a heat treatment intended to stabilize such a configuration in sections. In order to electrically connect the primary filament coils 100 and the first metal rod 106, all that would have to be done is to insert one of the coils of the primary filament coils 100 in the hook 106*a*. However, the heat treatment has a tendency to weaken the filament, so that such an operation might break the filament. This is why the spacer 104 is necessary. The same applies to the spacer 105.

However, the spacers 104 and 105 are manufactured such that they have a random curvature. If this curvature is towards the left with respect to the axis of revolution of the hook to which the spacer is connected, as is the case with the spacer 104, inserting the spacer 104 into the hook 106*a* is easy. This is because it suffices to place the spacer 104 and the secondary filament coils 102 to the right of the hook 106*a*, to offset the spacer 104 towards the front, and then towards the left and finally towards the rear so that it is inserted into the hook 106*a*.

During such an operation, the secondary filament coils 102 does not hit against the first metal rod 106. However, if the curvature of a spacer is towards the right with respect to the axis of revolution of the hook to which the spacer is connected, as is the case with the spacer 105, inserting the spacer 105 into the hook 107*a* is difficult. This is because, when the spacer 105 is offset towards the left, that is to say towards the right in FIG. 1A or towards the rear in FIG. 1B, the secondary filament coils 103 will hit against the second metal rod 107. Thus, in order to insert the spacer 105 into the hook 107*a*, it is necessary to apply additional force to the spacer 105, which risks breaking this spacer 105.

Figure 2B:
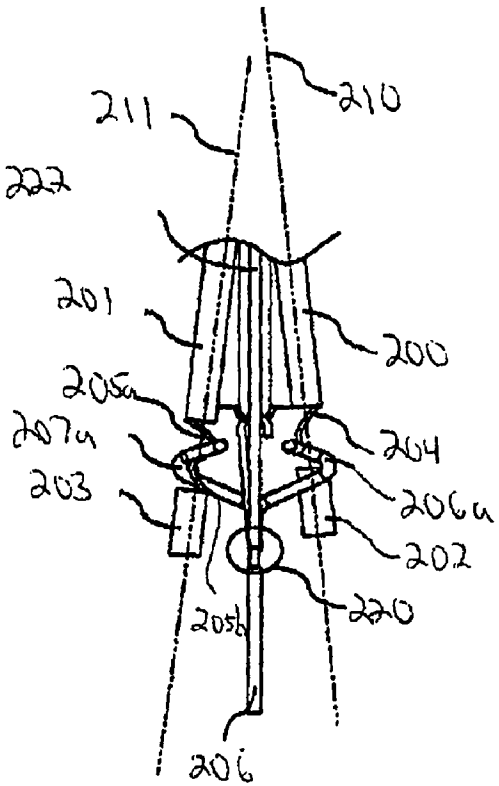
FIGS. 2A and 2B are a front view and a left-hand view of a filament assembly according to a first embodiment of the invention, respectively.
Figure 2A:
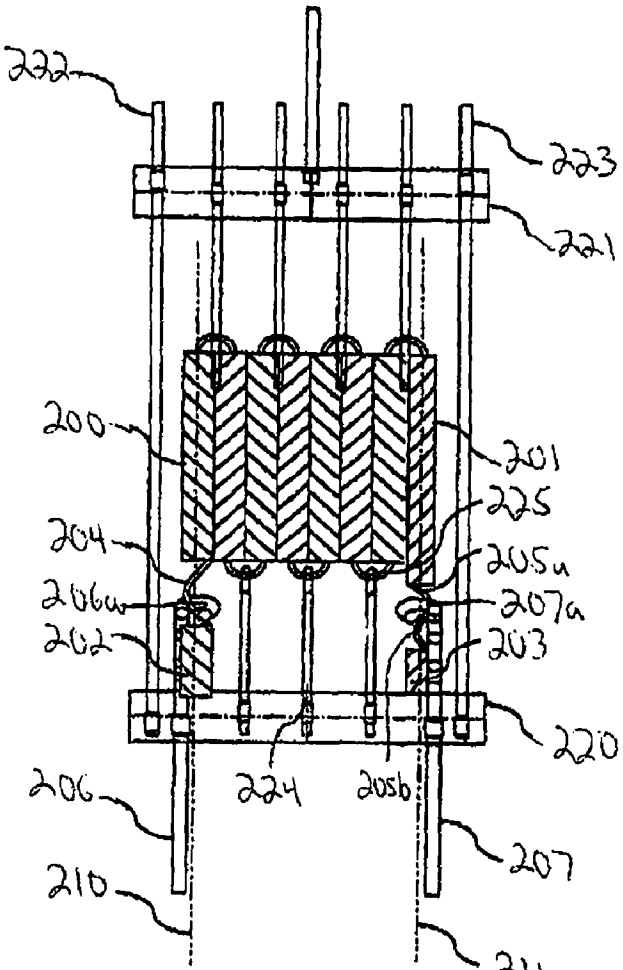

FIGS. 2A and 2B illustrate a filament assembly according to a first embodiment of the invention. The filament assembly of the first embodiment employs primary filament coils 200, primary filament coils 201, secondary filament coils 202, secondary filament coils 203, a spacer 204, a spacer 205, a metal supply rod 206 having a hook 206*a*, a metal supply rod 207 having a hook 207*a*, bridges 220 and 221 connected by metal bars 222 and 223, spacers 224, and filament loops 225. The primary filament coils 200 have a first axis of revolution 220, the primary filament coils 201 have a second axis of revolution 221. The axes of revolution of the hooks 206*a* and 207*a* coincide substantially with the first axis of revolution 220 and the second axis of revolution 221. It will be considered below that the axis of revolution of the hook 206*a* is the first axis of revolution 220 and that the axis of revolution of the hook 207*a* is the second axis of revolution 221. The filament employs four primary coil sections situated at the front of a plane defined by the spacers 224. Primary filament coils 200 is one of these four primary coil sections. The filament also employs four primary coil sections situated at the rear of a plane defined by the spacers 224. Primary filament coils 201 is one of these four primary coil sections.

However, unlike the prior art, in this first embodiment spacer 205 includes two coils 205*a* and 205*b* stretched in a direction parallel to the axis of revolution 221 of primary filament coils 201. Such stretching may be achieved by applying a traction force directed along the second axis of revolution 221 to the long helical part obtained by coiling of the tungsten wire. This force is applied before the heat treatment so as to obtain the coils 205*a* and 205*b* on opposite sides of the second axis of revolution 221. It may be applied before or after folding of the long helical part.

Such a stretching may also be obtained by modifying the coiling process adjacent coils 205*a* and 205*b*. This is because it is possible during coiling to adjust a separation between two consecutive coils of the filament. It is therefore possible to define a greater separation for coils 205*a* and 205*b*.

In the embodiment illustrated in FIGS. 2A and 2B, the filament assembly may be assembled as follows. A placement step first of all makes it possible to insert the spacer 204 into the hook for which insertion is easy. In this embodiment, due to the attachment point of the spacer 204 being situated to the left of the axis of revolution of the hook 206*a* and to the right of the axis of revolution of the hook 207*a*, the spacer 204 is inserted into the hook 206*a* since this insertion is easy, as explained in the description of FIGS. 1A and 1B. The spacer 205 having coils 205*a* and 205*b* for establishing two attachment points now necessarily has one of the two attachment points situated to the left of the axis of revolution of the hook 207*a* whereby inserting this attachment point into this hook 207*a* is also easy.

Figure 3B:
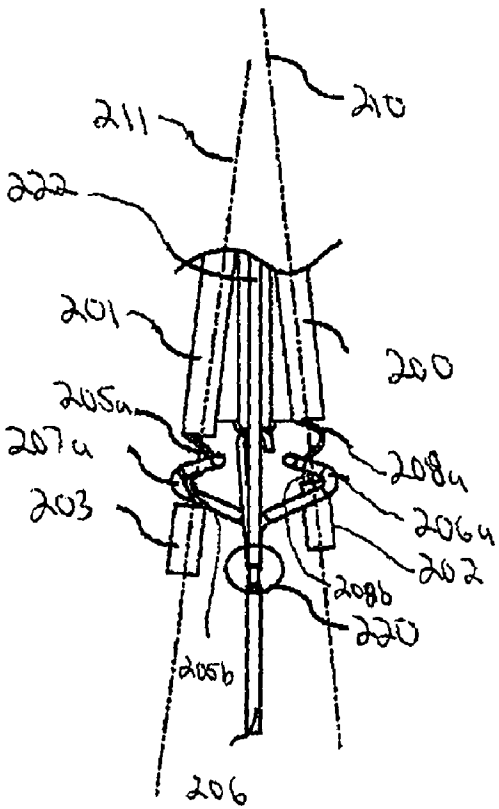
FIGS. 3A and 3B are a front view and a left-hand view of a filament assembly according to a second embodiment of the invention, respectively.
Figure 3A:
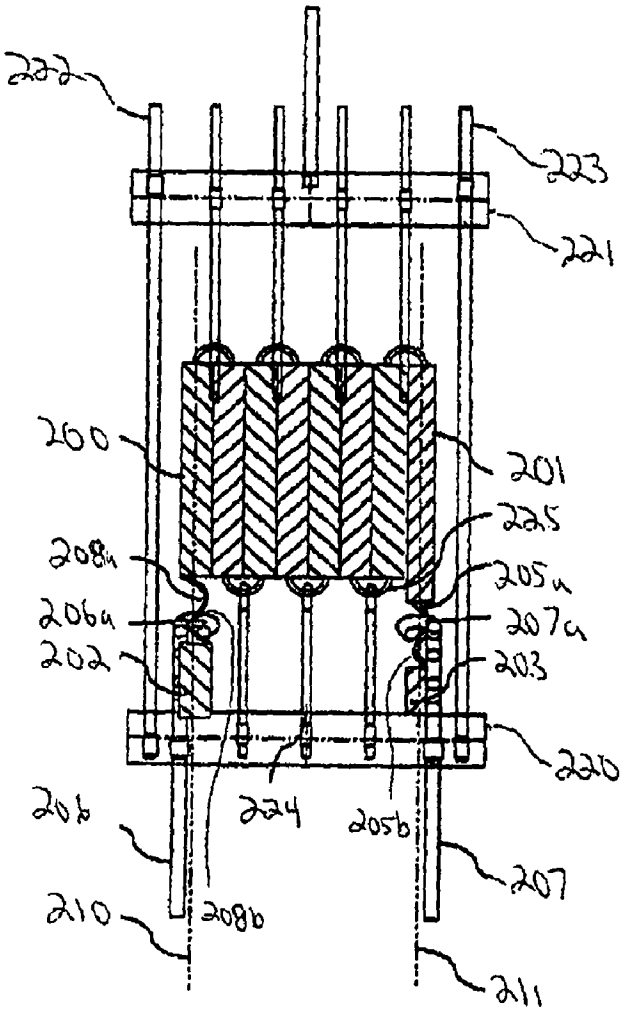

FIGS. 3A and 3B illustrate a filament assembly according to a second embodiment of the invention. Such a filament assembly employs elements identical to those described in the description of FIGS. 2A and 2B, except for spacer 204 which has been replaced by a spacer 208 having coils 208*a* and 208*b*. In this second embodiment, coils 208*a* and 208*b* are stretched in a direction parallel to the axis of revolution 220 of primary filament coils 200. Such a stretching is achieved as described in the description of FIGS. 2A and 2B.

In the example depicted in FIGS. 3A and 3B, coils 205*a* and 205*b* of one spacer establish two attachment points to hook 207*a* and coils 208*a* and 208*b* of the other spacer establish two attachment points to hook 206*a*. Thus, as with the embodiment illustrated in FIGS. 2A and 2B, the insertion of the spacers within hooks 206*a* and 207*a* is easy as compared to the prior art. Additionally, the spacer placement step described in connection with the description of the embodiment illustrated in FIGS. 2A and 2B is unnecessary for the embodiment illustrated in FIGS. 3A and 3B.

The above description with reference to the Figures illustrates the invention rather than limiting it. In this regard, a few remarks are made below. FIGS. 2A–3B illustrate examples of embodiments of the invention. The filament used is a tungsten filament obtained by coiling of a tungsten wire. Obviously, other materials may be used for manufacturing such a filament, provided that these materials emit light when an electric current passes through them.

In FIGS. 2A and 2B, the filament shown has several portions with substantially equivalent lengths, disposed in two planes. It is obviously possible, without departing from the spirit of the invention, to use filaments having different configurations, for example filaments comprising a different number of portions, for example a single portion, or lengths of portions different from one portion to another.

FIGS. 2A–3B illustrate a filament assembly connected to two metal supply rods where each rod has a hook. The invention also applies to filament assembly connected to a different number of metal supply rod hooks, notably a filament assembly having one end is welded to a metal rod and the other end is attached to another metal supply rod by an attachment system like the one described in the invention.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

The invention claimed is:

1. A filament assembly, comprising;

a first set of primary filament coils;

a first set of secondary filament coils; and a first spacer connecting said first set of primary filament coils to said first set of secondary filament coils, said first spacer including a first set of at least two coils for establishing at least two attachment points of said first spacer to a first metal current supply rod.

2. The filament assembly of claim 1, wherein said first set of primary filament coils are disposed in a first spiral around a first axis of revolution; and wherein said first set of at least two coils are stretched in a direction parallel to the first axis of revolution.

3. The filament assembly of claim 1, wherein said first set of at least two coils includes a first coil connected to said first set of primary filament coils, and wherein said first set of at least two coils includes a second coil connected to said first set of secondary filament coils.

4. The filament assembly of claim 1, wherein the first metal current supply rod includes a hook; and wherein one of said at least two attachment points is placed within the hook of the first metal current supply rod when said first spacer is attached to the first metal current supply rod.

5. The filament assembly of claim 1, further comprising;

a second set of primary filament coils;

a second set of secondary filament coils; and a second spacer connecting said second set of primary filament coils to said set of second secondary filament coils, said second spacer including a second set of at least two coils for establishing at least two attachment points of said second spacer to a second metal current supply rod.

6. The filament assembly of claim 5, wherein said second set of print filament coils are disposed in a second spiral around a second axis of revolution; and wherein said second set of at least two coils are stretched in a direction parallel to the second axis of revolution.

7. The filament assembly of claim 6, wherein said second set of at least two coils includes a first coil connected to said second set of primary filament coils, and wherein said second set of at least two coils includes a second coil connected to said second set of secondary filament coils.

8. The filament assembly of claim 5, wherein the second metal current supply rod includes a hook; and wherein one of said at least two attachment points is placed within the hook of the second metal current supply rod when said second spacer is attached to the second metal current supply rod.

9. A filament assembly, comprising:

a set of primary filament coils;

a set of secondary filament coils; and a spacer connecting said set of primary filament coils to said set of secondary filament coils, said spacer including means for establishing at least two attachment points of said spacer to a metal current supply rod.

10. An illumination assembly, comprising:

a first metal current supply rod;

a filament assembly including a first set of primary filament coils;

a first set of secondary filament coils; and a first spacer electrically connecting said first set of primary filament coils to said first set of secondary filament coils, said first spacer including a first set of at least two coils for establishing at least two attachment points of said first spacer to said first metal current supply rod; and wherein said first metal current supply rod is attached to one of said at least two attachment points of said first spacer.

11. The illumination assembly of claim 10, wherein said first set of primary filament coils are disposed in a first spiral around a first axis of revolution; and wherein said first set of at least two coils are stretched in a direction parallel to the first axis of revolution.

12. The illumination assembly of claim 10, wherein said first set of at least two coils includes a first coil connected to said first set of primary filament coils, and wherein said first set of at least two coils includes a second coil connected to said first set of secondary filament coils.

13. The illumination assembly of claim 10, wherein said first metal current supply rod includes a hook; and wherein the one of said at least two attachment points of said first spacer attached to said first metal current supply rod is placed within the hook of said first metal current supply rod.

14. The illumination assembly of claim 10, further comprising a second metal current supply rod;

wherein said filament assembly further includes:

a second set of primary filament coils;

a second set of secondary filament coils; and a second spacer connecting said second set of primary filament coils to said set of second secondary filament coils, said second spacer including a second set of at least two coils for establishing at least two attachment points of said second spacer to said second metal current supply rod; and wherein said second metal current supply rod is attached to one of said at least two attachment points of said second spacer.

15. The illumination assembly of claim 14, wherein said second set of primary filament coils are disposed in a second spiral around a second axis of revolution; and wherein said second set of at least two coils are stretched in a direction parallel to the second axis of revolution.

16. The illumination assembly of claim 14, wherein said second set of at least two coils includes a first coil connected to said second set of primary filament coils, and wherein said second set of at least two coils includes a second coil connected to said second set of secondary filament coils.

17. The illumination assembly of claim 14, wherein the second metal current supply rod includes a hook; and wherein the one of said at least two attachment points of said second spacer attached to said second metal current supply rod is placed within the hook of said second metal current supply rod.

* * * * *